United States Patent [19]

Meierhoefer

[11] Patent Number: 4,533,068

[45] Date of Patent: Aug. 6, 1985

[54] STERILE SOLUTION DELIVERY AND VENTING DEVICES

[75] Inventor: Eugene J. Meierhoefer, Hackettstown, N.J.

[73] Assignee: Health Care Concepts, Inc., Allamuchy, N.J.

[21] Appl. No.: 404,484

[22] Filed: Aug. 6, 1982

Related U.S. Application Data

[63] Continuation-in-part of Ser. No. 293,519, Aug. 14, 1981, abandoned.

[51] Int. Cl.[3] ..... B65D 37/00

[52] U.S. Cl. ..... 222/189; 222/213; 222/481; 222/494

[58] Field of Search ..... 215/118, 110, 306, 308; 220/371, 372, 375; 222/189, 211–213, 481, 482, 490, 491, 494, 498, 543, 562

[56] References Cited

U.S. PATENT DOCUMENTS

| | | | |
|---|---|---|---|
| 2,684,789 | 7/1954 | Marchant | 222/490 |
| 3,128,917 | 4/1964 | Krause | 222/564 |
| 3,149,758 | 9/1964 | Bush et al. | 222/189 |
| 3,227,332 | 1/1966 | Gowdy et al. | 222/498 |
| 3,608,793 | 9/1971 | Van Lobensels | 222/490 |
| 3,693,843 | 9/1972 | Perry et al. | 222/212 |
| 3,705,668 | 12/1972 | Schwartzman | 222/213 |
| 3,906,958 | 9/1975 | Knox | 604/129 |
| 3,952,902 | 4/1976 | Prouty et al. | 215/306 |
| 4,172,540 | 10/1979 | Erichson | 220/375 |
| 4,235,344 | 11/1980 | Kulle et al. | 215/308 |
| 4,239,132 | 12/1980 | Mueller et al. | 222/212 |

*Primary Examiner*—H. Grant Skaggs
*Attorney, Agent, or Firm*—William E. Hedges

[57] ABSTRACT

Sterile solution delivery and venting devices for use with multi-dose sterile solution packages are disclosed. The devices include a positive acting, normally closed check valve which opens to express solution from the package when squeezing pressure is applied and which automatically closes when the pressure is released. A hydrophobic filter is included to sterilize the replacement air which enters the package upon release of the squeezing pressure.

1 Claim, 13 Drawing Figures

FIG. 9
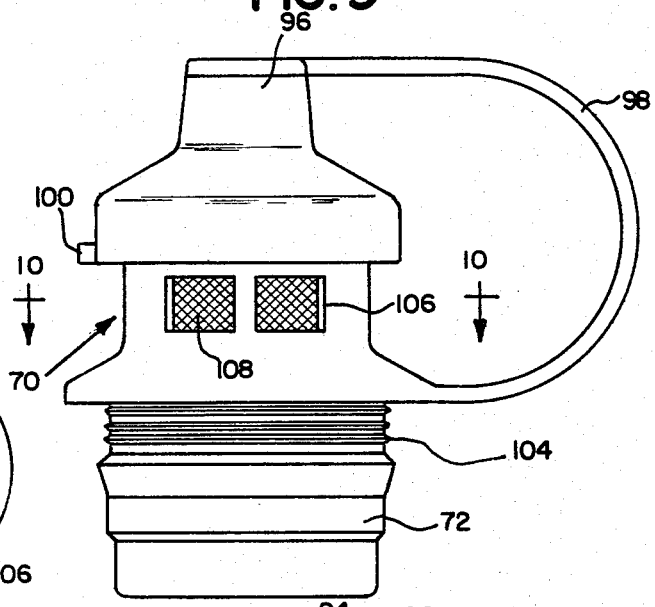
FIG. 10
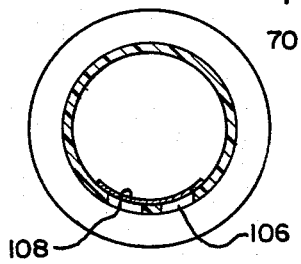
FIG. 13
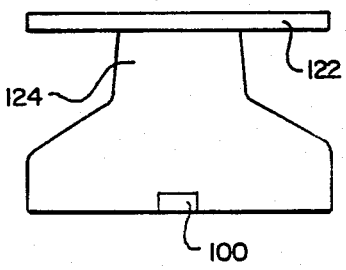
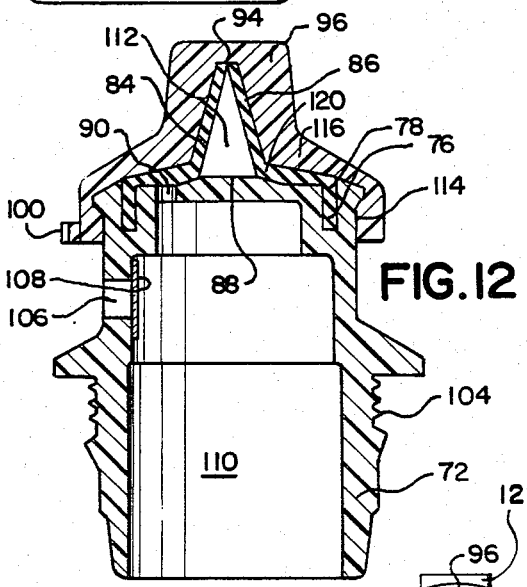
FIG. 12
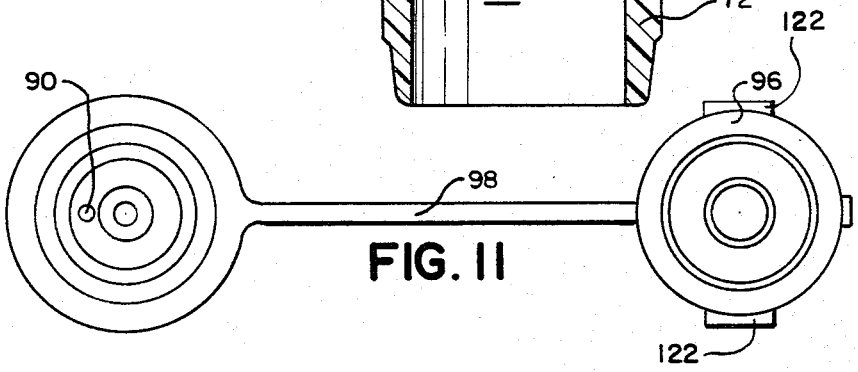
FIG. 11

STERILE SOLUTION DELIVERY AND VENTING DEVICES

The present application is a continuation-in-part of Meierhoefer U.S. patent application Ser. No. 293,519, filed Aug. 14, 1981, now abandoned.

BACKGROUND OF THE INVENTION

The present invention relates generally to the field of sterile fluid dispensing devices, and more particularly, is directed to novel delivery and venting devices capable of maintaining sterile conditions within a multi-dose dispensing container.

Sterile solutions are useful for certain medicinal and opthalmic applications in which it is desirable to expel a portion of a sterile liquid from a multi-dose container for treatment purposes while maintaining the integrity of the remaining sterile solution. In such applications, it is necessary either to provide a bacteriostatic agent in the solution itself or to remove microorganisms and other contaminants from the flow of replacement air into the container. It is also necessary to ensure that the fluid dispensing path permits no intrusion of contaminants into the container after dispensing a portion of the sterile solution.

In widely accepted practice, the solution delivery is accomplished by generating sufficient dispensing pressure by squeezing the container and then providing means for replacement air to enter the container. A preservative is employed to permit multi-dose usage.

In one presently employed application, a sterile solution has been developed for daily cleaning and disinfection of contact lenses. Presently available sterile solutions for such use are usually stored in a multi-dose bottle to which a bacteriostatic agent has been added to maintain the sterile integrity of the solution. Due to the physiological characteristics of the users, the bacteriostatic agents added for preservation of sterility frequently cause discomfort and irritation to the eyes after the lenses have been treated with such a preserved solution. In fact, presently available commercial contact lens disinfection solutions supplied in multi-dose containers carry warning labels offering instructions to the user in the event that eye irritation occurs.

In view of the fact that the multi-dose containers presently in use must include a preservative to maintain the sterility of the solution, and because of the eye irritation that frequently occurs, other workers in the art have developed single service containers which remain sealed until use. In this way a non-preserved, sterile, lens solution is dispensed which contains no bacteriostatic agent and thus no irritant is transmitted to the eye of the user. While such single service containers are useful to accomplish the desired purpose, the very fact that a small container must be developed and manufactured for only one time use adds a considerable increase in cost to the single treatment application. Due to the high cost of a single service container when compared to the cost of a multi-dose package, the need remains to provide a multi-dose container capable of maintaining a sterile solution without requiring the addition of a bacteriostatic agent. The present invention is addressed to the solution of this problem.

SUMMARY OF THE INVENTION

The present invention relates generally to the field of sterile solutions, and more particularly, is directed to improved sterile solution delivery and venting devices which are designed to permit the storage and dispensing of a quantity of sterile solution without the addition of a preservative.

The present invention is directed to delivery and venting devices for use with a multi-dose, economical size package or container for a sterile, non-preserved solution in a manner to permit multiple uses in incremental amounts until the container is emptied. The devices include air filter means to prevent contamination of any non-preserved solution remaining within the container after any of the incremental uses, and check valve or other means in the fluid dispensing path, to prevent the entrance of contaminants through the fluid dispensing nozzle.

The delivery and venting devices include a hollow dispensing body which is equipped with a positive acting, normally closed check valve which is operable when squeezing pressures are applied to the solution container to express from the package a quantity of sterile solution under pressure for solution application purposes. The body additionally carries a filtering means to treat the incoming air which must enter the interior of the package to replace any fluid and air which had been expressed through the check valve, after the squeezing pressures upon the container are released. The filter means includes a hydrophobic (non-wetting) membrane suitable to treat all incoming air to thereby sterilize the air prior to entrance thereof into the interior of the package.

It is an important feature of this invention that the check valve or other means be suitably designed to permit the exit of fluid, whether air or liquid, from within the container outwardly through the check valve or the like with no possibility of reverse fluid flow into the container interior. Make-up air following the expelling of the fluid from within the container travels through the air sterilizing membrane of the filter means prior to entering the container and contacting the solution. This construction provides a multi-dose package capable of preserving the integrity of the sterile solution without requiring the addition of a possibly eye irritating preservative.

It is therefore an object of the present invention to provide improved sterile solution delivery and venting devices of the type set forth.

It is another object of the present invention to provide novel multi-dose sterile solution delivery and venting systems which function to maintain the integrity of a sterile solution in a multi-dose container without requiring a bacteriostatic agent.

It is another object of the present invention to provide novel sterile solution delivery and venting devices which incorporate a positive acting, normally closed, check valve means in combination with a hydrophobic membrane air sterilizing filter means.

It is another object of the present invention to provide novel sterile solution delivery and venting devices for use with a multi-dose container which include a positive acting, normally closed, check valve, a hydrophobic membrane filter and means to protect the check valve and the filter from contamination by touching.

It is another object of the present invention to provide a novel sterile solution delivery and venting device including a body having a liquid outlet port and an air inlet port, a check valve positioned within the outlet port and a hydrophobic filter positioned in the inlet port, the check valve being openable upon the application of hydraulic pressure built up within a container and being automatically sealed upon release of the hydraulic pressure.

It is another object of the present invention to provide a novel sterile solution delivery and venting device for use with a multi-dose container that is simple in design, inexpensive in manufacture and trouble-free in use.

Other objects and a fuller understanding of the invention will be had by referring to the following description and claims of preferred embodiments thereof, taken in conjunction with the accompanying drawings, wherein like reference characters refer to similar parts throughout the several views and in which:

BRIEF DESCRIPTION OF THE DRAWINGS

FIG. 9 is a side elevational view of the device of FIGS. 7 and 8.

FIG. 10 is a cross-sectional view of the device of FIG. 9 taken along the line 10—10 of FIG. 9.

FIG. 11 is a bottom plan view of the cap.

FIG. 12 is a cross sectional view of the device taken at right angles to FIGS. 7 and 8.

FIG. 13 is a side elevational view of the cap showing a finger piece to aid in removal and closure of the cap without touching the dispensing device.

DESCRIPTION OF THE PREFERRED EMBODIMENTS OF THE INVENTION

Figure 1:
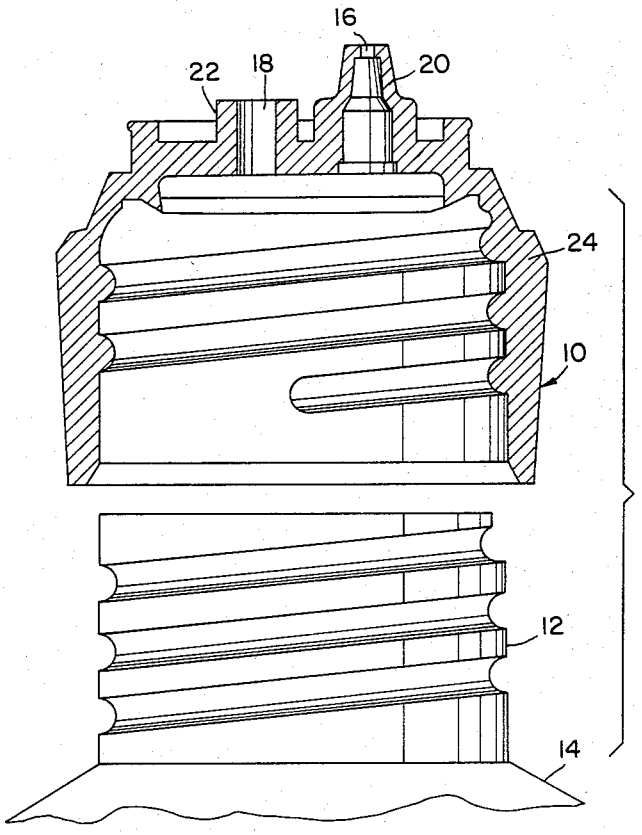
FIG. 1 is a cross sectional view showing a sterile solution delivery and venting device body without filter and check valve in place above the neck of a multi-dose, sterile solution container.

Although specific terms are used in the following description for the sake of clarity, these terms are intended to refer only to the particular structures of the invention selected for illustration in the drawings, and are not intended to define or limit the scope of the invention.

Referring now to the drawings, there is illustrated in FIG. 1 a sterile solution delivery and venting device 10 applied to the neck 12 of a compressible, multi-dose, sterile solution container or package 14. The delivery and venting device 10 comprises generally a formed body 24 which may be fabricated in well known manner of suitable sturdy material, for example molded polyethylene plastic or polyproylene plastic.

Figure 2:
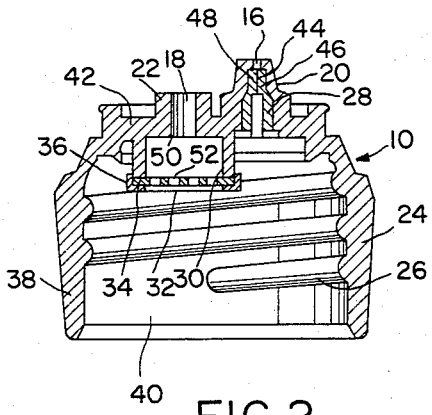
FIG. 2 is a cross-sectional view similar to FIG. 1 showing a first modified sterile solution delivery and venting device.

As best seen in FIG. 2, the body 24 is downwardly open to overfit the threaded neck 12 of the container 14 and is generally of hollow cylindrical configuration, having side walls 38 defining interior threads 26 for threaded interconnection with the container neck 12. The body side walls 38 define an interior cavity 40 within which fluid, both liquid and air, can readily flow when the device is in operation. The side walls 38 terminate upwardly and define an integral, generally closed top 42. The top 42 and the body side walls 38 are molded or otherwise formed to a unitary construction and are impervious to the passage of liquid or gas. The integral construction preserves the integrity of the sterile solution (not illustrated) stored within the multi-dose bottle 14 by not permitting the passage of contaminents therethrough. The top 42 is molded or otherwise configured to define an integral spout 20 and a return air boss 22. The spout 20 includes a spray or dispensing port 16, which port is in fluid communication with the body interior cavity 40. The return air boss 22 defines a return air inlet port 18, which port is also in fluid communication with the body interior cavity 40.

Referring still to FIG. 2, a check valve 28 is secured inwardly of the spout 20 in known manner to permit the passage of sterile solution (not shown) therethrough when the compressible container 14 is squeezed or otherwise compressed to express the sterile solution from the container 14. The check valve 28 preferably is of the so-called duck-bill type having a dispensing opening 44 defined by a pair of flattened, adjacent lips 46, 48, which lips are designed to close tightly immediately upon release of squeezing forces on the container or multi-dose package 14, thereby to prevent the entrance of non-sterile air therethrough. The check valve 28 is fabricated in known manner and may be duck-bill check valve Number VA 3272 as manufactured and sold by Vernay Laboratories. A closure similar to that described in U.S. Pat. No. 3,825,157 could also be employed. Accordingly, when the compressible, squeezable bottle 14 is compressed, the pressure thereby created will be sufficient to express the sterile solution (not shown) from within the container through the check valve dispensing opening 14 by deforming the lips 46, 48. The solution will exit under pressure through the spray port 16 for sterile solution application purposes. Immediately upon release of the compressing forces applied to the multi-dose package 14, the duck-bill check valve 28 will function automatically to close the dispensing opening 44 by returning the lips 46, 48 to their closed, straight position as illustrated.

Still referring to FIG. 2, in one embodiment, the inward terminus 50 of the air inlet port 18 can be provided with an interior cylindrical housing or seat 30 upon which is secured a filter 52 which comprises generally a filter housing 34, a hydrophobic membrane 32 and a suitable attaching collar or clip 36, which clip functions to secure the filter 52 upon the inner terminus of the seat 30. The hydrophobic membrane 32 is known to those skilled in the art, and as described in U.S. Pat. No. 3,149,758, the hydrophobic membrane is not wet by the liquid and thereby maintains its effectiveness to pass air into the container and to filter all microorganisms therefrom. It is noteworthy that both the filter means 52 and the check valve 28 are interiorly secured within the body 24 and are therefore completely protected from contamination which might be caused from direct outside contact.

Figure 3:
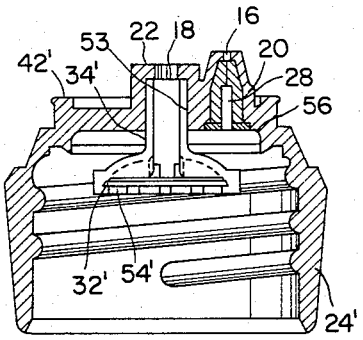
FIG. 3 is a cross-sectional view similar to FIG. 2 showing a second embodiment of a sterile solution delivery and venting device.

Referring now to FIG. 3, a modified body 24′ is illustrated comprising a similar fluid spout 20 and a similar duck bill check valve 28. The return air boss 22 includes the air inlet port 18 and defines inwardly a conduit 53 within which a hollow filter housing 34′ can be secured in known, air-tight manner. As illustrated, the top 42′ of the body 24′ may be configured to form an interior shaped recess 56. The housing 34′ carries a supporting grid and the filter means 54′ which includes a hydrophobic membrane 32′. The housing 34′ seats within the conduit 53 and is peripherally sealed therein to assure that all air entering through the inlet port 18 passes through and is treated by the membrane 32′.

Figure 4:
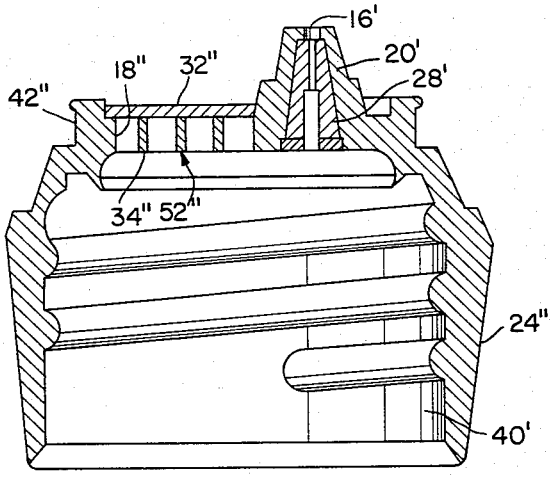
FIG. 4 is an enlarged, cross-sectional view similar to FIG. 2 illustrating a third embodiment of a sterile solution delivery and venting device.

In the embodiment of FIG. 4, the body 24″ comprises a fluid spout 20′ which defines a spray port 16′ for fluid dispensing. A rubber or other flexible material duck bill valve 28′ is secured inwardly of the spout 20′ in known manner by a snap ring or other suitable retaining member and is operatively sealed in place. The body top 42″ is provided with a modified air inlet port 18″ within which is located a filter means 52″ comprising a supporting housing 34″ and a hydrophobic membrane 32″. The air inlet port 18″ communicates directly with the body interior cavity 40′ whereby all incoming air must pass through and be treated by the filter means 52″. Preferably, the supporting housing 34″ is formed as an integral part of the closure molding and the filter membrane 32″ is sealed in known manner to the molded grid 34″.

Figure 5:
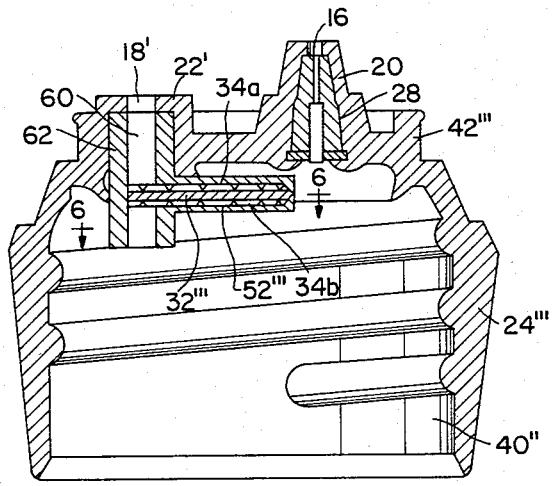
FIG. 5 is an enlarged, cross-sectional view similar to FIG. 2, showing a fourth embodiment of a sterile solution delivery and venting device.
Figure 6:
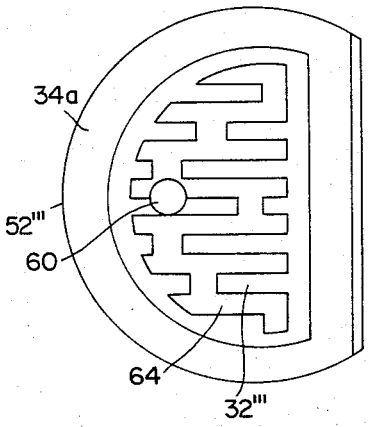
FIG. 6 is an enlarged, cross-sectional view taken along line 6—6 on FIG. 5, looking in the direction of the arrows.

Referring now to FIGS. 5 and 6, a modified sterile solution delivery and venting device is illustrated which includes generally a body 24‴ including an integral top 42‴ which defines an interior cavity 40″. The top includes a fluid spout 20 having a port 16 in the manner hereinbefore described. A duck bill check valve 28 is operatively secured within the spout 20 to provide one-way solution flow when external pressures are applied upon the solution container (not shown).

The device top is formed with a return air boss 22′ having an air inlet port 18′ provided therethrough to permit the entrance of make-up air into the container in the usual manner following a solution expressing procedure. The make-up air is treated by the filter means 52‴ prior to entrance into the cavity 40″ to preserve the sterile integrity of the sterile solution which is stored within the multi-dose container (both not shown). In the embodiment illustrated, a filter support 62 is secured within the return air boss 22′. The support 62 includes a return air conduit 60 in fluid communication with the port 18′ to direct the make-up air through the hydrophobic membrane 32‴. Upper and lower filter housings 34*a*, 34*b*, extend from the support 62 and are peripherally sealed to sandwich the membrane 32‴ therebetween in sturdy construction.

Figure 7:
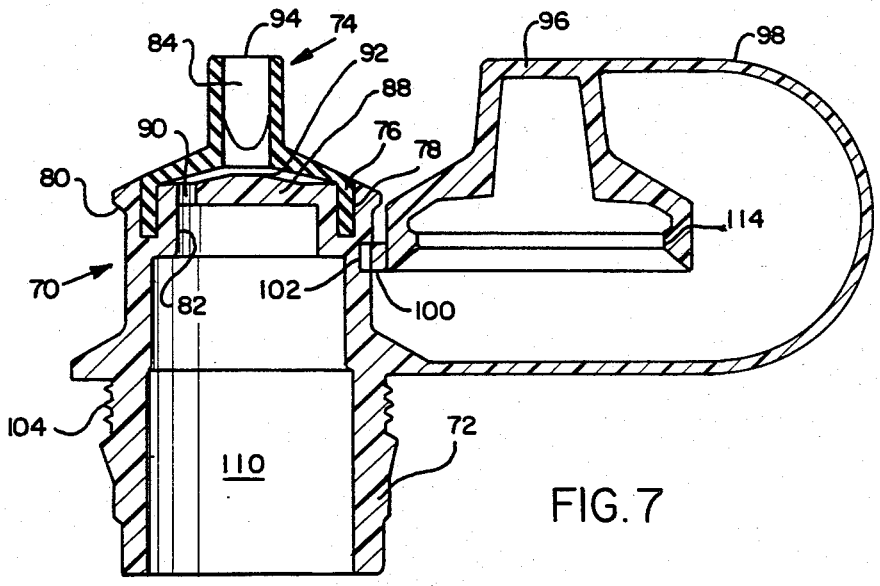
FIG. 7 is a cross-sectional view of a fifth embodiment of a sterile solution delivery and venting device having a captive cap shown in open position.

FIG. 7 is a cross-sectional view of an especially preferred embodiment of the invention which includes means to prevent accidental discharge of the sterile liquid and in which the hydrophobic sterilizing air filter membrane is so arranged that it can not be occluded by sterile fluid.

This embodiment of a sterile solution delivery and venting device 70 comprises the neck 72 of a compressible multi-dose container in which is sealed a duck bill check valve 74. More specifically, in the embodiment of FIG. 7, the duck bill valve has a depending circular flange 76 which is press-fitted in a circular seat 78 between the outer wall 80 and an inner circular wall 82 of the circular flange or skirt of the valve 74. The press fit provides a liquid tight seal between the valve 74 and neck 72 of the bottle, not shown. The duck bill valve 74 is suitably composed of rubber or other deformable material and has a pair of adjacent lips 84, 86 (only one of which is visible in FIG. 7), which are normally in direct contact on their inner surfaces, thus providing a normally closed valve. The top 88 of the neck 72 is closed except for a port 90 which permits sterile liquid (not shown) to be expressed from the compressible bottle or container, not shown, into the space 92 between the top 88 of the neck and the under side of the valve 74. The liquid then flows under pressure from compression of the bottle into the spout of the duck bill valve forcing the lips 84, 86 apart and squirting or spraying from the thus formed exit port 94 of the valve 74. Release of squeezing or compressive force on the bottle releases the pressure on the sterile liquid allowing the lips 84, 86 of the duck bill valve to resume their in contact normally closed valve position.

The device also includes a captive cap 96 connected to the neck 72 by a resilient retainer strap 98. When the cap is in open position, not shown, it is free to fly away from the duck bill valve at the end of the resilient strap. The resiliency of the strap may have a tendency to hold the open cap in a position which might interfere with the dispensing of sterile liquid. To avoid this problem, the cap 96 is provided with a boss or tab 100 which can be press fitted into a slot 102 provided in the neck 72 to hold the cap 96 in anchored open position as shown in FIG. 7.

Figure 8:
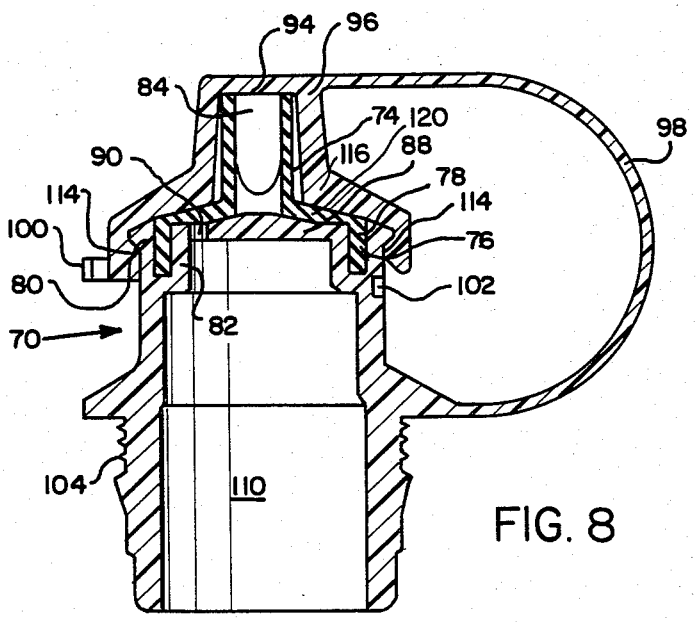
FIG. 8 is a cross-sectional view of the device of FIG. 7 with the cap in closed position.

The sterile solution delivery and venting device of FIGS. 7 and 8 is shown in side elevation in FIG. 9 with the cap in closed position. The outer wall of the device at a position outside of the cap 96 is provided with one or more windows 106 closed by a hydrophobic air sterilizing filtering material 108 which may be fused or otherwise secured to the wall of the neck 72 to seal the windows to preclude outward flow of sterile liquid. The windows 106 and filter material 108 are shown in cross-section in FIG. 10.

The lower portion of the neck 72 of device 70 is provided with one or more projecting sealing rings 104 which provide a liquid tight seal when the device is press fitted into the body of a deformable multi-use container, not shown.

In operation, the cap 96 is released and, if desired, anchored to the device as shown in FIG. 7 to keep it out of the way, but in open position. The body of the container, not shown, is then squeezed or compressed forcing sterile liquid, not shown, up into the interior cavity 110 of the neck 72 of device 70. The sterile liquid is then forced out of the cavity 110 through the port 90 in closed top 88 of the neck. The sterile liquid then flows through the space 92 between the closed top 88 and a central cavity 112 of the duck bill valve. The sterile liquid then forces the lips 84, 86 (FIG. 12) apart to permit the liquid to be sprayed or squirted out of the exit port 94 of the valve 74.

The tapered normally closed configuration of the duck bill valve, and the space 92 between the interior of the valve and the top of the neck 88 are best seen in FIG. 12.

As noted above, the especially preferred embodiment of FIGS. 7–12 is provided with means to prevent accidental discharge of sterile liquid and to prevent such liquid from occluding the filter. More specifically the cap 96 is so dimensioned that it closes the duck bill valve when the cap is closed, thus preventing discharge of sterile fluid when the multi-use container is not in use, e.g. during storage or transit. The cap 96 has an inwardly extending peripheral flange 114 which press fits over a flange 116 on the neck 72 of the device. When the cap is thus press fitted in closed position on the neck 72 the shoulders 118 of the cap are tightly pressed against the shoulders 120 of the duck bill valve so that the latter (120) are deformed downwardly against the top 88 of the neck to close the port 90 and the space 92, thus preventing flow of sterile liquid into the duck bill valve. In this way, no matter how the multi-dose container is handled or compressed, no liquid can be discharged when the cap is closed.

It is also noted that even if the device is exposed to liquid from an external source, the hydrophobic filters will not be occluded when the device is in an in-use position, since they are in a vertical plane.

When the body of the multi-use container is squeezed or compressed to provide pressure to force the sterile liquid out of the duck bill valve the volume of liquid and air in the container is reduced. This of course creates a partial vacuum in the container. This vacuum serves two purposes. First it causes any sterile liquid remaining in the duck bill valve and space 92 to be drawn back into the container. Indeed, the pressure differential between the higher external pressure and the lower internal pressure will force the deformable shoulders 120 of the duck bill valve down against the top 88 of the neck thus forcing any remaining sterile fluid back into the container through port 90.

The internal vacuum in the container also serves to draw air into the container through the filters 108 in windows 106 until the pressures are equilibrated. The filter material 108 is permeable to air but not to liquid or bacteria or any other contaminants. Therefore, the integrity of the sterile liquid is maintained without the use of an antibacterial agent which could be irritating to the eyes of a user of contact lenses washed with such a liquid.

Location of the windows 106 and filters 108 outside of the cap 96 permits the multi-use containers to equilibrate after use even with the cap in place for storage prior to the next use.

The new multi-dose containers and the sterile solution delivery and venting devices are preferably made of moldable thermoplastics known to the art per se which permit the filled, assembled and sealed packages to be sterilized by steam or a steam/air mixture according to conventional practice in a commercial steam autoclave without disturbing the integrity of the seal between the neck and body of the container.

FIG. 13 is a side elevation of the cap 96 showing a finger tab 122 which aids in opening and closing the cap. The cap also has a neck 124 which, with the finger tab 122, permits the cap to be grasped and opened or closed without finger contact with the duck bill valve obviating any possible contamination.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. A squeeze bottle for storing and dispensing multiple doses of a sterile liquid comprising:

a closed hollow body to contain said sterile liquid;

said body having a neck portion;

a normally closed deformable duck-bill valve mounted in said neck;

an air inlet port in said neck;

hydrophobic filter means mounted vertically behind said air inlet port;

captive cap means movable between an open dispensing position and a closed position covering said duck-bill valve and preventing finger touching contamination thereof;

co-operating means on said cap and the outside of said body to anchor said cap out of the flow of dispensed liquid when the cap is in open position;

said normally closed duck-bill valve operating, when the cap is on open position, in response to pressure created by squeezing said bottle to dispense sterile liquid and automatically closing on release of squeezing pressure;

said dispensing of sterile liquid creating a partial vacuum within said bottle;

said vacuum in cooperation with the structure of the squeeze bottle serving the dual purpose of causing sterile liquid remaining in the duck-bill valve and the space in the neck directly below the valve to be drawn back into the body of said bottle and providing a differential pressure between the vacuum within the bottle and the higher atmospheric pressure outside the bottle, whereby the external pressure compresses the deformable duck-bill valve down against said neck thus forcing any remaining sterile liquid back into the body of the bottle;

said hydrophobic filter means having a pore size which precludes passage of liquid and such that it sterilizes air passing into the bottle through the filter for equilibration of said vacuum;

said hydrophobic filter means and said air inlet port being spaced below said cap to permit said equilibration to take place even when the cap is in closed position;

the vertical disposition of said hydrophobic filter preventing occlusion of said filter by external liquid when the squeeze bottle is in use position;

said cap when in closed position being tightly pressed against the external surface of the duck-bill valve thus preventing said valve from opening and discharging liquid no matter how the bottle is handled or squeezed when the cap is in closed position.

* * * * *